US005876887A

United States Patent [19]

Chambers et al.

[11] Patent Number: 5,876,887

[45] Date of Patent: Mar. 2, 1999

[54] CHARGE GENERATION LAYERS COMPRISING PIGMENT MIXTURES

[75] Inventors: John S. Chambers, Rochester; Huoy-Jen Yuh, Pittsford; James M. Markovics, Rochester; Yonn K. Rasmussen, Fairport, all of N.Y.

[73] Assignee: Xerox Corporation, Stamford, Conn.

[21] Appl. No.: 806,952

[22] Filed: Feb. 26, 1997

[51] Int. Cl.[6] ..... G03G 5/06

[52] U.S. Cl. ..... 430/58; 430/78

[58] Field of Search ..... 430/58, 59, 71, 430/72, 78

[56] References Cited

U.S. PATENT DOCUMENTS

| | | | |
|---|---|---|---|
| 3,442,781 | 5/1969 | Weinberger | 204/181 |
| 3,871,882 | 3/1975 | Wiedemann | 96/1.5 |
| 3,904,407 | 9/1975 | Regensburger et al. | 96/1.5 |
| 3,972,717 | 8/1976 | Wiedemann | 96/1.5 |
| 3,992,205 | 11/1976 | Wiedemann | 96/1.5 |
| 4,232,102 | 11/1980 | Horgan et al. | 430/58 |
| 4,286,033 | 8/1981 | Neyhart etal. | 430/58 |
| 4,291,110 | 9/1981 | Lee | 430/59 |
| 4,338,387 | 7/1982 | Hewitt | 430/58 |
| 4,415,639 | 11/1983 | Horgan | 430/57 |
| 4,419,427 | 12/1983 | Graser et al. | 430/58 |
| 4,429,029 | 1/1984 | Hoffmann et al. | 430/57 |
| 4,469,769 | 9/1984 | Nakazawa et al. | 430/78 |
| 4,501,906 | 2/1985 | Spietschka et al. | 549/232 |
| 4,514,482 | 4/1985 | Loutfy et al. | 430/78 |
| 4,517,270 | 5/1985 | Graser et al. | 430/58 |
| 4,555,463 | 11/1985 | Hor et al. | 430/59 |
| 4,556,622 | 12/1985 | Neumann et al. | 430/58 |
| 4,578,333 | 3/1986 | Staudenmayer et al. | 430/60 |
| 4,587,189 | 5/1986 | Hor et al. | 430/59 |
| 4,639,403 | 1/1987 | Podszuen et al. | 430/115 |
| 4,664,995 | 5/1987 | Horgan et al. | 430/59 |
| 4,709,029 | 11/1987 | Spietschka et al. | 544/125 |
| 4,714,666 | 12/1987 | Wiedemann et al. | 430/59 |
| 4,719,163 | 1/1988 | Staudenmayer et al. | 430/58 |
| 4,746,741 | 5/1988 | Staudenmayer et al. | 546/37 |
| 4,937,164 | 6/1990 | Duff et al. | 430/58 |
| 4,968,571 | 11/1990 | Gruenbaum et al. | 430/58 |
| 4,988,595 | 1/1991 | Pai et al. | 430/59 |
| 5,019,473 | 5/1991 | Nguyen et al. | 430/58 |
| 5,089,369 | 2/1992 | Yu | 430/96 |
| 5,091,278 | 2/1992 | Teuscher et al. | 430/58 |
| 5,164,276 | 11/1992 | Robinson et al. | 430/59 |
| 5,225,307 | 7/1993 | Hor et al. | 430/106 |
| 5,344,734 | 9/1994 | Monbaliu et al. | 430/73 |

FOREIGN PATENT DOCUMENTS

| | | |
|---|---|---|
| 0 040 402 A2 | 5/1981 | European Pat. Off. . |
| 59-31957 | 2/1984 | Japan . |
| 59-119356 | 7/1984 | Japan . |
| 59-119357 | 7/1984 | Japan . |
| 59-140454 | 8/1984 | Japan . |
| 59-140456 | 8/1984 | Japan . |
| 59-157646 | 9/1984 | Japan . |
| 59-157651 | 9/1984 | Japan . |

OTHER PUBLICATIONS

Ernst–Günther Schlossen, "A New Organic Double–Layer System and Its Photoconduction Mechanism," *Journal of Applied Photographic Engineering*, vol. 4, No. 3, p. 118 (1978).

*Primary Examiner*—John Goodrow
*Attorney, Agent, or Firm*—Oliff & Berridge, PLC

[57] ABSTRACT

An electrophotographic imaging member has a support, and at least one photoconductive layer having from about 90% by weight to about 10% by weight of the photoconductive particles of a photosensitive substituted perylene pigment, and, correspondingly, from about 10% by weight to about 90% by weight of at least one other n-type photosensitive pigment that is sensitive to shorter wavelength light than is the perylene pigment.

19 Claims, 1 Drawing Sheet

CHARGE GENERATION LAYERS COMPRISING PIGMENT MIXTURES

BACKGROUND OF THE INVENTION

This invention relates, in general, to electrophotography and, in particular, to charge generation layers for electrophotographic imaging members using a tungsten exposure.

In electrophotography, an electrophotographic imaging member containing a photoconductive insulating layer on a conductive layer is imaged by first uniformly electrostatically charging its surface. The imaging member is then exposed to a pattern of activating electromagnetic radiation, such as light. The radiation selectively dissipates the charge in the illuminated areas of the photoconductive insulating layer, while leaving behind an electrostatic latent image in the non-illuminated areas. This electrostatic latent image can then be developed to form a visible image by depositing finely divided electroscopic marking particles on the surface of the photoconductive insulating layer. The resulting visible image can then be transferred from the electrophotographic imaging member to a support, such as paper. This imaging process can be repeated many times with reusable photoconductive insulating layers.

As such photoconductive materials, inorganic materials have often been used. In electrophotographic photoreceptors, for example, inorganic photoreceptors provided with a photosensitive layer that contains selenium, zinc oxide, or cadmium sulfide as the primary component have been widely used.

However, these inorganic photoreceptors are not always satisfactory in characteristics of photosensitivity, thermal stability, moisture resistance, and durability, which are essential for electrophotographic photoreceptors used in copying machines. For example, selenium is liable to crystallize from heat or stain, creating finger spots.

For improving upon the disadvantages of inorganic photoconductive materials, various organic photoconductive materials have come to attract much attention in the art, and a number of approaches have been made to use them in the photosensitive layer of electrophotographic photoreceptors.

An electrophotographic imaging member may be provided in any of a number of forms. For example, the imaging member may be a homogeneous layer of a single material such as vitreous selenium, or it may be a composite layer containing a photoconductor and another material. One type of composite imaging member comprises a layer of finely divided particles of a photoconductive insulating organic compound dispersed in an electrically insulating organic resin binder.

U.S. Pat. No. 3,904,407 to Regensburger et al. discloses an electrophotographic plate having a photoreceptor comprising a photoinjecting pigment selected from the class of perylene pigments and an active transport material that is substantially transparent in the wavelength region of xerographic use and capable of supporting charge carrier injection from the pigment.

U.S. Pat. No. 4,232,102 to Horgan et al. discloses an imaging member comprising a layer of organic resin in which a photoconductive material comprising trigonal selenium is dispersed. This layer can be the charge generation layer in an imaging member also containing a charge transport layer. The photoconductive material so prepared is useful for improving cyclic charge acceptance and control, and for improving dark decay.

U.S. Pat. No. 4,578,333 to Staudenmayer et al. discloses an imaging member comprising a charge generating layer comprising a photoconductive pigment such as a perylene compound, a charge transport layer, and an acrylonitrile copolymer interlayer disposed between the charge generating layer and the support.

U.S. Pat. No. 4,587,189 to Hor et al. discloses photoconductive imaging members comprising a vacuum sublimation deposited benzimidazole perylene charge generating layer for photoelectric imaging and performance enhancement.

U.S. Pat. No. 4,639,402 to Mishra et al. discloses an imaging member comprising an organic resin binder and photoconductive materials containing selenium particles coated with a hydrolyzed amino silane.

U.S. Pat. No. 4,988,595 to Pai et al. discloses a listing of photoconductive materials including, inter alia, amorphous and trigonal selenium, phthalocyanines, dibromoanthanthrone, and benzimidazole perylene, that can be used as charge generating materials in photogenerating layers. It is further disclosed that charge generating binder layers comprising particles or layers comprising a photoconductive material such as vanadyl phthalocyanine, metal free phthalocyanine, benzimidazole perylene, amorphous selenium, trigonal selenium, selenium alloys such as selenium-tellurium, selenium-tellurium-arsenic, selenium arsenide, and the like and mixtures thereof are especially preferred because of their sensitivity to white light. See, also, U.S. Pat. Nos. 5,089,369 and 5,164,276.

There is a continuing interest in the development of photoreceptors in which manufacture is simplified, print defects are reduced, particularly over extended use, and useful life is lengthened. Benzimidazole perylene (BzP) is a useful pigment in such photoreceptors because, in addition to being an organic pigment, it represents no health threat or other hazard to the environment, such as some other inorganic and other known carcinogenic organic pigments. Another reason for using BzP is that it is a pigment with good cyclic and environmental stability with regard to its xerographically relevant electrical properties, while simultaneously possessing adequate photosensitivity across nearly all of the visible spectrum.

Using BzP alone as the photoactive pigment results in two machine performance shortfalls. The first is the possible appearance of background print-out. Such background can be acceptably diminished by altering the xerographic setpoints of a xerographic machine, but doing so would violate the goal of designing a photoreceptor that performs equivalently to the photoreceptors having a tungsten light source that are already on the market.

The second manifestation of machine performance shortfall due to the use of BzP alone as the photoactive pigment is in the relative grey level response to various colored input document color and halftone patches. That is, for example, the relative grey level response to a blue patch compared to a yellow patch of the same value on the input document results in one ratio of output grey levels for a photoreceptor already marketed, and a different output grey level ratio for a particular photoreceptor design using BzP alone as the photoactive pigment. Owing to the shape of the spectral response inherent to BzP pigment as compared with that of the desired response, in combination with the input optics, simple design changes in the BzP based photoreceptor, such as layer thicknesses, or pigment to binder ratios, or similar such design parameters as are well known in the art, cannot provide adequately equivalent grey level response to various colored input as the desired response, while simultaneously maintaining equivalent xerographic electrical properties.

SUMMARY OF THE INVENTION

It is these two machine performance shortfalls of the known single pigment photoreceptor designs, the overall actinic photosensitivity and relative grey level response to colored input, which this invention addresses.

Further, it is a goal of this invention that a particular set of pigments with particular relationships of peak spectral sensitivities, as well as predominant charge carrier nature (n-type, as opposed to p-type), and ionization potentials, be combined to match the actinic response to a particular color temperature tungsten exposure system, and to sufficiently mimic the spectral response of a target photoreceptor in a particular target machine so as to achieve a photoreceptor that is functionally equivalent to the target photoreceptor in the target machine.

The present invention is directed to an electrophotographic imaging member comprising a support and at least one photoconductive layer comprising (a) a substituted perylene compound and (b) at least one other n-type photosensitive pigment.

More particularly, the present invention is directed to an electrophotographic imaging member comprising:

(a) a support, and (b) at least one photoconductive layer comprising:

(i) from about 10% by weight to about 90% by weight of the photoconductive layer of a photosensitive substituted perylene pigment, and (ii) from about 90% by weight to about 10% by weight of the photoconductive layer of at least one other n-type photosensitive pigment that is sensitive to shorter wavelength light than is the perylene pigment.

In a preferred embodiment, the present invention is directed to an electrophotographic imaging member comprising:

(a) a support, and (b) at least one photoconductive layer comprising:

(i) from about 70% by weight to about 90% by weight of the photoconductive layer of benzimidazole perylene, and (ii) from about 30% by weight to about 10% by weight of the photoconductive layer of at least one other n-type photosensitive pigment selected from the group consisting of selenium and dibromoanthanthrone.

BRIEF DESCRIPTION OF THE DRAWING

The accompanying FIGURE is a cross-sectional view of a multi-layer photoreceptor in which the photoconductive layer of the present invention can be employed.

DETAILED DESCRIPTION OF PREFERRED EMBODIMENTS

Figure 1:
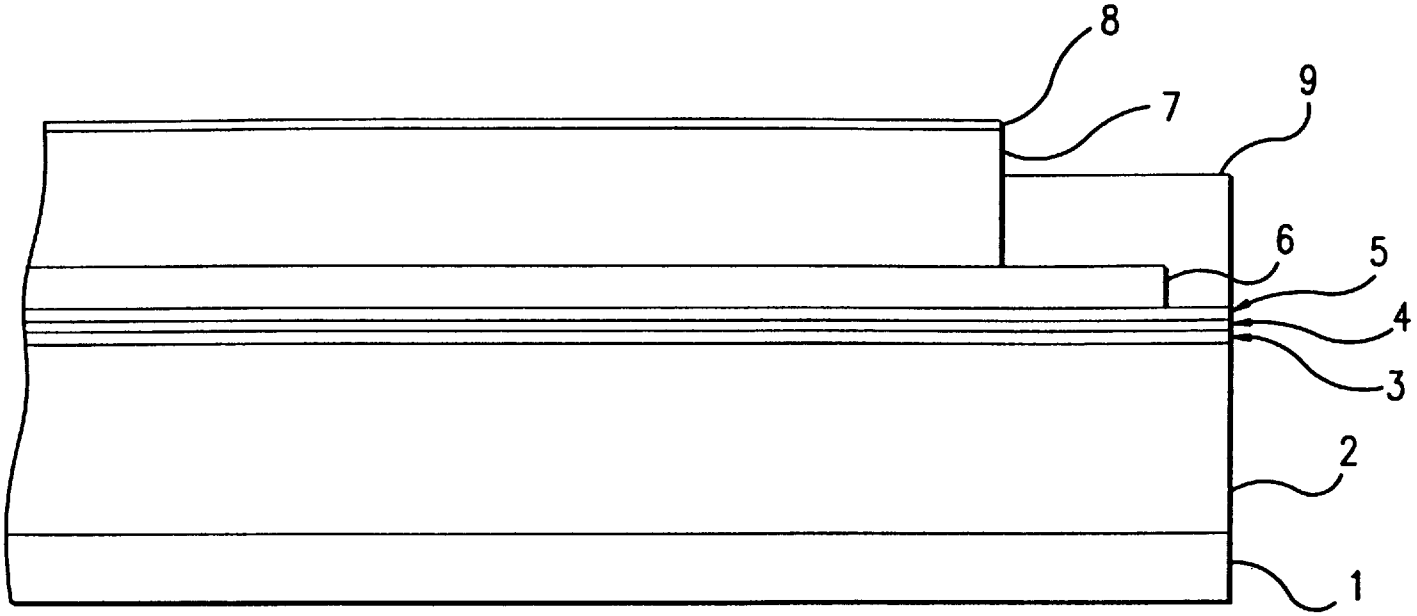

The present invention is directed to an electrophotographic imaging member comprising a support and at least one photoconductive layer comprising (a) a photosensitive substituted perylene compound primary pigment and (b) at least one other n-type photosensitive secondary pigment that is preferably sensitive to shorter wavelength light than is the perylene pigment.

This invention is particularly directed to a particular class of photoreceptor designs that is targeted toward light lens applications using broad band exposure from a tungsten light source, which has a wavelength range of 450–750 nm. In particular, the imaging member of the present invention enables the tuning of the spectral sensitivity, especially the spectral convolution of the sensitivity with the exposure source, called the "actinic sensitivity." This tuning of the sensitivity is accomplished by mixing at least two pigments, one from the perylene family and designated herein as the primary pigment and at least one other pigment, designated as the secondary pigment(s). In the present invention, the primary and secondary pigments have similar electronic carrier transport properties and are preferably n-type, indicating that the predominant mobile carrier is an electron, as opposed to a hole, but have different quantum efficiencies (the ratio of photoproduced carriers to incident photons).

The specific pigment mixtures of the present invention are chosen by targeting their actinic sensitivity, rather than by matching sensitivities at a particular wavelength or across a specified range of wavelengths, as has been done by others in the art. Here, the desired actinic sensitivity is from about 400 to about 800 nm. The primary pigment may have an actinic specificity range higher than that of the secondary pigment. For example, the actinic sensitivity of the primary pigment could be in the range of from about 500–700 nm, while the actinic sensitivity of the secondary pigment could be in the range of from about 450 to 650 nm. Other criteria include targeting the visible spectral range, rather than the infra-red, and limiting the pigments chosen to similar carrier types (n-type) and similar ionization potentials.

The predominant carrier type, as discussed above, should be electrons, meaning that the hole range is shorter than the electron range, as in BzP. Mixtures of two pigments with opposite carrier types, such as BzP (electrons as charge carriers) and any of a number of pthalocyanine pigments well known in the art (holes as the predominant charge carriers), results in unacceptable performance due to the trapping of photogenerated charges in the mixed pigment layer.

In addition, even for pigments with the same carrier type, the ionization potentials of both pigments should preferably be less than that of the binder in which they are dispersed, and more than that of the transport molecule with which they must exchange charge in a charge transfer process. The secondary pigment should preferably have an ionization potential not less than that of the primary pigment.

The ionization potential of the perylene compound is from about 5.2–5.6 eV. The second pigment should have an ionization potential of from about 5.3–6.0 eV. The transport molecule should have an ionization potential from about 5.2–5.7 eV. The binder should have an ionization potential greater than or equal to 6.0 eV.

A representative structure of an electrophotographic imaging member in which the photoconductive layer of the present invention can be employed is shown in the FIGURE. This imaging member is provided with an anti-curl layer 1, a supporting substrate 2, an electrically conductive ground plane 3, a charge blocking layer 4, an adhesive layer 5, a charge generating layer 6, a charge transport layer 7, an overcoating layer 8, and a ground strip 9.

The Anti-curl Layer

For some applications, an optional anti-curl layer 1 can be provided, which comprises film-forming organic or inorganic polymers that are electrically insulating or slightly semi-conductive. The anti-curl layer provides flatness and/or abrasion resistance.

Anti-curl layer 1 can be formed at the back side of the substrate 2, opposite the imaging layers. The anti-curl layer may comprise, in addition to the film-forming resin, an adhesion promoter polyester additive. Examples of film-forming resins useful as the anti-curl layer include, but are not limited to, polyacrylate, polystyrene, poly(4, 4'isopropylidene diphenylcarbonate), poly(4,4'-cyclohexylidene diphenylcarbonate, mixtures thereof and the like.

Typical adhesion promoters useful as additives include, but are not limited to, duPont 49,000 (duPont), Vitel PE-100, Vitel PE-200, Vitel PE-307 (Goodyear), mixtures thereof and the like. Usually from about 1 to about 15 weight percent adhesion promoter is selected for film-forming resin addition, based on the weight of the film-forming resin.

The thickness of the anti-curl layer is typically from about 3 micrometers to about 35 micrometers and, preferably, about 14 micrometers. However, thicknesses outside these ranges can be used.

The anti-curl coating can be applied as a solution prepared by dissolving the film-forming resin and the adhesion promoter in a solvent such as methylene chloride. The solution may be applied to the rear surface of the supporting substrate (the side opposite the imaging layers) of the photoreceptor device, for example, by hand coating or by other methods known in the art. The wet film coating is then dried to produce the anti-curl layer 1.

The Supporting Substrate

As indicated above, the photoreceptors are prepared by first providing a substrate 2, i.e., a support. The substrate can be opaque or substantially transparent and can comprise any of numerous suitable materials having given required mechanical properties. In embodiments, an aluminum drum is the preferred substrate.

The substrate can comprise a layer of electrically non-conductive material or a layer of electrically conductive material, such as an inorganic or organic composition. If a non-conductive material is employed, it is necessary to provide an electrically conductive ground plane over such non-conductive material. If a conductive material is used as the substrate, a separate ground plane layer may not be necessary.

The substrate can be flexible or rigid and can have any of a number of different configurations, such as, for example, a sheet, a scroll, an endless flexible belt, and the like. Preferably, the photoreceptor is coated on a rigid, opaque, conducting substrate, such as an aluminum drum.

Various resins can be used as electrically non-conducting materials, including, but not limited to, polyesters, polycarbonates, polyamides, polyurethanes, and the like. Such a substrate preferably comprises a commercially available biaxially oriented polyester known as Mylar, available from E. I. duPont de Nemours & Co., Melinex, available from ICI Americas Inc., or Hostaphan, available from American Hoechst Corporation. Other materials of which the substrate may be comprised include polymeric materials, such as polyvinyl fluoride, available as Tedlar from E. I. duPont de Nemours & Co., and polyimides, available as Kapton from E. I. duPont de Nemours & Co. The photoreceptor can also be coated on an insulating plastic drum, provided a conducting ground plane has previously been coated on its surface, as described above.

When a conductive substrate is employed, any suitable conductive material can be used. For example, the conductive material can include, but is not limited to, metal flakes, powders or fibers, such as aluminum, titanium, nickel, chromium, brass, gold, stainless steel, carbon black, graphite, or the like, in a binder resin including metal oxides, sulfides, silicides, quaternary ammonium salt compositions, conductive polymers such as polyacetylene or its pyrolysis and molecular doped products, charge transfer complexes, and polyphenyl silane and molecular doped products from polyphenyl silane. A conducting plastic drum can be used, as well as the preferred conducting metal drum made from a material such as aluminum.

The preferred thickness of the substrate depends on numerous factors, including the required mechanical performance and economic considerations. The thickness of the substrate is typically within a range of from about 65 micrometers to about 150 micrometers, and preferably is from about 75 micrometers to about 125 micrometers for optimum flexibility and minimum induced surface bending stress when cycled around small diameter rollers, e.g., 19 mm diameter rollers. The substrate for a flexible belt can be of substantial thickness, for example, over 200 micrometers, or of minimum thickness, for example, less than 50 micrometers, provided there are no adverse effects on the final photoconductive device. Where the preferred aluminum drum is used, the thickness should be sufficient to provide the necessary rigidity. This is usually about 1–6 mm.

The surface of the substrate to which a layer is to be applied is preferably cleaned to promote greater adhesion of such a layer. Cleaning can be effected, for example, by exposing the surface of the substrate layer to plasma discharge, ion bombardment, and the like. Other methods, such as solvent cleaning, can be used.

Regardless of any technique employed to form a metal layer, a thin layer of metal oxide generally forms on the outer surface of most metals upon exposure to air. Thus, when other layers overlying the metal layer are characterized as "contiguous" layers, it is intended that these overlying contiguous layers may, in fact, contact a thin metal oxide layer that has formed on the outer surface of the oxidizable metal layer.

The Electrically Conductive Ground Plane

As stated above, photoreceptors prepared in accordance with the present invention comprise a substrate that is either electrically conductive or electrically non-conductive. When a non-conductive substrate is employed, an electrically conductive ground plane 3 must be employed, and the ground plane acts as the conductive layer. When a conductive substrate is employed, the substrate can act as the conductive layer, although a conductive ground plane may also be provided.

If an electrically conductive ground plane is used, it is positioned over the substrate. Suitable materials for the electrically conductive ground plane include, but are not limited to, aluminum, zirconium, niobium, tantalum, vanadium, hafnium, titanium, nickel, stainless steel, chromium, tungsten, molybdenum, copper, and the like, and mixtures and alloys thereof. In embodiments, aluminum, titanium, and zirconium are preferred.

The ground plane can be applied by known coating techniques, such as solution coating, vapor deposition, and sputtering. A preferred method of applying an electrically conductive ground plane is by vacuum deposition. Other suitable methods can also be used.

Preferred thicknesses of the ground plane are within a substantially wide range, depending on the optical transparency and flexibility desired for the electrophotoconductive member. Accordingly, for a flexible photoresponsive imaging device, the thickness of the conductive layer is preferably between about 20 angstroms and about 750 angstroms; more preferably, from about 50 angstroms to about 200 angstroms for an optimum combination of electrical conductivity, flexibility, and light transmission. However, the ground plane can, if desired, be opaque.

The Charge Blocking Layer

After deposition of any electrically conductive ground plane layer, a charge blocking layer 4 can be applied thereto. Electron blocking layers for positively charged photoreceptors permit holes from the imaging surface of the photoreceptor to migrate toward the conductive layer. For negatively charged photoreceptors, any suitable hole blocking layer capable of forming a barrier to prevent hole injection from the conductive layer to the opposite photoconductive layer can be utilized.

If a blocking layer is employed, it is preferably positioned over the conductive layer. The term "over," as used in many instances herein in connection with many different types of layers, should be understood as not being limited to instances wherein the layers are contiguous. Rather, the term refers to relative placement of the layers and encompasses the inclusion of unspecified intermediate layers.

The blocking layer 4 can include polymers, such as polyvinyl butyryl, epoxy resins, polyesters, polysiloxanes, polyamides, polyurethanes, and the like; nitrogen-containing siloxanes or nitrogen-containing titanium compounds, such as trimethoxysilyl propyl ethylene diamine, N-0(aminoethyl) y-aminopropyl trimethoxy silane, isopropyl 4-aminobenzene sulfonyl titanate, di(dodecylbenezene sulfonyl) titanate, isopropyl di(4aminobenzoyl)isostearoyl titanate, isopropyl tri(N-ethyl amino) titanate, isopropyl trianthranil titanate, isopropyl tri(N,N-dimethyl-ethyl amino) titanate, titanium-4-amino benzene sulfonate oxyacetate, titanium 4-aminobenzoate isostearate oxyacetate, y-aminobutyl methyl dimethoxy silane, y-aminopropyl methyl dimethoxy silane, and y-aminopropyl trimethoxy silane, as disclosed in U.S. Pat. Nos. 4,338,387, 4,286,033, and 4,291,110.

A preferred hole blocking layer comprises a reaction product of a hydrolyzed silane or a mixture of hydrolyzed silanes and the oxidized surface of a metal ground plane layer. The oxidized surface inherently forms on the outer surface of most metal ground plane layers when exposed to air after deposition. This combination enhances electrical stability at low relative humidity. The hydrolyzed silanes can then be used as is well known in the art. For example, see U.S. Pat. No. 5,091,278 to Teuscher et al.

The blocking layer 4 should be continuous and can have a thickness of up to 2 micrometers depending on the type of material used.

However, the blocking layer preferably has a thickness of less than about 0.5 micrometer because greater thicknesses may lead to undesirably high residual voltage. A blocking layer between about 0.005 micrometer and about 0.3 micrometer is satisfactory for most applications because charge neutralization after the exposure step is facilitated and good electrical performance is achieved. A thickness between about 0.03 micrometer and about 0.06 micrometer is preferred for blocking layers for optimum electrical behavior.

The blocking layer 4 can be applied by any suitable technique, such as spraying, dip coating, draw bar coating, gravure coating, silk screening, air knife coating, reverse roll coating, vacuum deposition, chemical treatment, and the like. For convenience in obtaining thin layers, the blocking layer is preferably applied in the form of a dilute solution, with the solvent being removed after deposition of the coating by conventional techniques, such as by vacuum, heating, and the like. Generally, a weight ratio of blocking layer material and solvent of between about 0.5:100 to about 5.0:100 is satisfactory for spray coating.

The Adhesive Layer

An intermediate layer 5 between the blocking layer and the charge generating layer may, if desired, be provided to promote adhesion. However, in the present invention, a dip coated aluminum drum is the preferred substrate and is normally utilized without an adhesive layer.

Additionally, adhesive layers can be provided, if necessary, between any of the layers in the photoreceptors to ensure adhesion of any adjacent layers. Alternatively, or in addition, adhesive material can be incorporated into one or both of the respective layers to be adhered. Such optional adhesive layers preferably have thicknesses of about 0.001 micrometer to about 0.2 micrometer. Such an adhesive layer can be applied, for example, by dissolving adhesive material in an appropriate solvent, applying by hand, spraying, dip coating, draw bar coating, gravure coating, silk screening, air knife coating, vacuum deposition, chemical treatment, roll coating, wire wound rod coating, and the like, and drying to remove the solvent. Suitable adhesives include, for example, film-forming polymers, such as polyester, dupont 49,000 (available from E. I. duPont de Nemours & Co.), Vitel PE-100 (available from Goodyear Tire and Rubber Co.), polyvinyl butyryl, polyvinyl pyrrolidone, polyurethane, polymethyl methacrylate, and the like. The invention is not affected by the adhesive layers.

The Charge Generating Layer

The photoreceptors embodying the present invention can be prepared by applying over the conductive layer the charge generation layer 6 and, optionally, a charge transport layer 7. In embodiments, the charge generation layer and, when present, the charge transport layer, may be applied in either order.

The charge generation layer is typically applied by applying a charge generation coating composition comprising a charge generation film-forming binder, solvent for the charge generation film-forming binder, and photogenerating particles. One or more dopants may optionally be added. In the present invention, the photogenerating particles comprise the above-mentioned primary and secondary pigments.

The primary pigments employed in the present invention are those of the perylene family of compounds. This family includes, for example, the cis- and trans-isomers of benzimidazole perylene, which have an actinic sensitivity of 500–700 nm and have the formulas bisbenzimidazo(2,1-a:1',2'-b')anthra(2,1,9-def:6,5,10-d'e'f')diisoquinoline-6,11-dione and bisbenzimidazo(2,1-a:2',1-a')anthra(2,1,9-def:6,5,10-d'e'f')diisoquinoline-10,21-dione, which are particularly suitable for use in the present invention. These perylene pigments are disclosed in U.S. Pat. Nos. 4,587,189 and 5,225,307, the entire disclosures of which are incorporated herein by reference. Further, perylene pigments, including perylene bismides and bisimidazo perylene dimers, are disclosed in U.S. patent application serial No. 08/700,326, filed Aug. 8, 1996, the entire disclosure of which is incorporated herein by reference.

The selection of selected perylene pigments as photoconductive substances is also known. There is thus described in Hoechst European Patent Publication 0040402 DE3019326, filed May 21, 1980, the use of N,N'-disubstituted perylene-3,4,9,10 tetracarboxyldiimide pigments as photoconductive substances. Specifically, there are for example, disclosed in this publication N,N'-bis(3-methoxypropyl)perylene-3,4,9,10-tetracarboxyldiimide dual layered negatively charged photoreceptors with improved spectral response in the wavelength region of 400–700 nanometers. A similar disclosure is revealed in Ernst Gunther Schlosser, *Journal of Applied Photographic Engineering,* Vol. 4, No. 3, page 118 (1978). There are also disclosed in U.S. Pat. No. 3,871,882 photoconductive substances comprised of specific perylene-3,4,9,10-tetracarboxylic acid derivative dyestuffs. In accordance with the teachings of this patent, the photoconductive layer is preferably formed by vapor depositing the dyestuff in a vacuum. Also, there is specifically disclosed in this patent dual layer photoreceptors with perylene-3,4,9,10-tetracarboxylic acid diimide derivatives, which have spectral response in the wavelength region of from 400 to 600 nanometers. Further, in U.S. Pat. No. 4,555,463, the disclosure of which is totally incorporated herein by reference, there is illustrated a layered imaging member with a chloroindium phthalocyanine photogenerating layer. In U.S. Pat. No. 4,587,189, the disclosure of which is totally incorporated herein by reference, there is illustrated a layered imaging member with a nonhalogenated perylene pigment photogenerating component.

Moreover, there are disclosed in U.S. Pat. No. 4,419,427 electrographic recording mediums with a photosemiconductive double layer comprised of a first layer containing charge carrier perylene diimide dyes, and a second layer with one or more compounds that are charge transporting materials when exposed to light, reference the disclosure in column 2, beginning at line 20.

The two general types of monomeric perylene pigment, illustrated as follows, are commonly referred to as perylene bis(imides) and bis(imidazo) perylenes.

rated thin charge generation layers (CGLs) in photoconductive devices coated with a charge transporting layer (CTL). U.S. Pat. No. 3,904,407, the disclosure of which is totally incorporated herein by reference, illustrates the use of bisimide compounds (Formula 1a, R=alkyl, aryl, alkylaryl, alkoxyl or halogen, or heterocyclic substituent) with preferred pigments being R=chlorophenyl or methoxyphenyl. This patent illustrates the use of certain vacuum evaporated perylene pigments or a high loaded dispersion of pigment in a binder resin as CGL in layered photoreceptors with a CTL overcoat or, alternatively, as a single layer device in which the perylene pigment is dispersed in a charge transporting active polymer matrix. The use of purple to violet dyestuffs with specified chromaticity values, including bisimidazo perylenes, specifically cis and trans bis(benzimidazo) perylene (Formula 1b, X=1,2-phenylene) and bis(1,8-naphthimidazo)perylene (Formula 1b, X=1,8-naphthylene), is disclosed in U.S. Pat. No. 3,972,717. This patent also describes the use of vacuum-evaporated CGLs in layered photoconductive devices. The use of a plurality of pigments, inclusive of perylenes, in vacuum evaporated CGLs is illustrated in U.S. Pat. No. 3,992,205.

U.S. Pat. No. 4,419,427 describes the use of highly-loaded dispersions of perylene bisimides, with bis(2,6-dichlorophenylimide) being a preferred material, in binder resins as CGL layers in devices overcoated with a charge transporting layer such as a poly(vinylcarbazole) composition. U.S. Pat. No. 4,429,029 illustrates the use of bisimides and bisimidazo perylenes in which the perylene nucleus is halogenated, preferably to an extent where 45 to 75 percent

FORMULA I

Photoconductive Perylene Pigments from Perylene-3,4-9,10-tetracarboxylic Acid Dianhydride

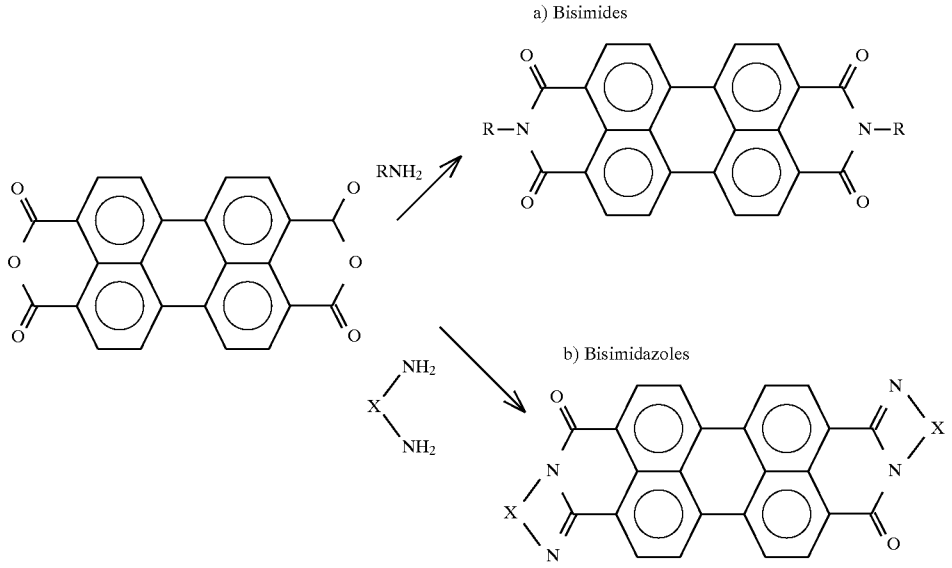

These perylenes can be prepared by reacting perylene tetracarboxylic acid dianhydride with primary amines or with diamino-aryl or -alkyl compounds. Their use as photoconductors is disclosed in U.S. Pat. Nos. 3,871,882, the disclosure of which is totally incorporated herein by reference, and 3,904,407. U.S. Pat. No. 3,871,882 discloses the use of the perylene dianhydride and bisimides in general (Formula 1a, R=H, lower alkyl (C1 to C4), aryl, substituted aryl, aralkyl, a heterocyclic group or the NHR' group in which R' is phenyl, substituted phenyl or benzoyl) as vacuum evapoof the perylene ring hydrogens have been replaced by halogen. U.S. Pat. No. 4,587,189, the disclosure of which is totally incorporated herein by reference, describes layered photoresponsive imaging members prepared using highly loaded dispersions or, preferably, vacuum evaporated thin coatings of cis- and trans bis(benzimidazo)perylene and other perylenes overcoated with hole transporting compositions comprised of a variety of N,N,N',N'-tetraaryl-4,4'-diaminobiphenyls. U.S. Pat. No. 4,937,164 illustrates the use of perylene bisimides and bisimidazo pigments in which the 1,12 and/or 6,7 position of the perylene nucleus is bridged by one or 2 sulfur atoms wherein the pigments in the CGL layers are either vacuum evaporated or dispersed in binder resins in similar devices incorporating tetraaryl biphenyl hole transporting molecules.

While the above described layered perylene-based photoreceptors, or photoconductive imaging members, may exhibit desirable xerographic electrical characteristics, most of the bisimides are red to brown in color, and possess, it is believed, relatively poor spectral response, particularly to the 600 to 700 nanometer region of the spectrum. The majority of the bis(imidazo) pigments, especially those with a purple to violet color, have poor spectral response in the blue (400 to 450 nanometers) region of the spectrum. Ideally, a photoconductive pigment used for light lens imaging, particularly for color photocopying, should have a uniform spectra response, that is be panchromatic throughout the visible spectrum from 400 to 700 nanometers. EU 40,402 (Wiedemann, Hoechst) discloses as a possible photogenerator a dark crystal form of bis(3-methoxypropylimido)perylene that provided spectral response from just over 400 to above 650 nanometers. U.S. Pat. No. 4,517,270 illustrates bisimides with propyl, hydroxypropyl, methoxypropyl and phenethyl substituents that are black or dark primarily because of their crystal properties, and perylene pigments that are nuclearly substituted with anilino, phenylthio, or p-phenyazoanilino groups. Pigments of these type were indicated as providing "good electrophotographic recording media with panchromatic absorption characteristics." Similarly, in U.S. Pat. No. 4,719,163 and U.S. Pat. No. 4,746,741, the pigment, N,N'-bis(2-(3-methylphenyl)ethyl)perylene-3,4,9,10-bis(dicarboximide) Formula (1a, R=3-methyl, $C_6H_5CH_2CH_2$—) is indicated as providing layered electrophotograpic devices having spectral response to beyond 675 nanometers.

Perylene pigments that are unsymmetrically substituted have also been used as CGL (charge generating layer) materials in layered photoreceptors. The preparation and applications of these pigments, which can be either bis(imides) in which the imide nitrogen substituents (R in Formula 1a) are different or have monoimide-monoimidazo structures, is described in U.S. Pat. Nos. 4,501,906, 4,709,029 and 4,714,666. U.S. Pat. No. 4,968,571 discloses the use of a large variety of unsymmetrically substituted perylenes with one phenethyl radical bonded to the imide nitrogen atom. It is disclosed that the use of mixtures of two or more of these pigments in dispersion CGLs affords devices having excellent photosensitivity and resistance to abrasion.

Two additional patents relating to the use of perylene pigments in layered photoreceptors are U.S. Pat. No. 5,019,473, which illustrates a grinding process to provide finely and uniformly dispersed perylene pigment in a polymeric binder with excellent photographic speed, and U.S. Pat. No. 5,225,307, which discloses a vacuum sublimation process that provides a photoreceptor pigment, such as bis(benzimidazo)perylene formula (1b, X=1,2-phenylene) with superior electrophotographic performance.

The following patents relate to the use of perylene compounds, either as dissolved dyes or as dispersions in single layer electrophotographic photoreceptors usually based on sensitized poly(vinyl carbazole) compositions: U.S. Pat. Nos. 4,469,769, 4,514,482, and 4,556,622 and Japanese Patent Publications JP 84-31,957, JP 84-119,356, JP 84-119,357, JP 84-140,454, JP 84-140,456, JP 84-157,646, and JP 84-157,651.

As the secondary, or auxiliary, pigments of the present invention, which bring about the tuning referred to above, any of the various well-known n-type pigments can be used. It is preferred that such n-type pigments be those that absorb actinic light at wavelengths lower than the wavelength at which the perylene compound absorbs. Examples of such n-type photosensitive pigments that can be employed in the practice of this invention are amides of perylene perinone, chalcogens of selenium II-VI or tellurium III-V compounds, amorphous selenium, trigonal selenium, and selenium alloys, such as, for example, selenium-tellurium, selenium-tellurium-arsenic and selenium arsenide, dibromoanthanthrone, squarylium, quinacridones available from E. I. duPont de Nemours & Co. under the trade name Monastral Red, Monastral Violet, and Monastral Red Y, dibromoanthanthrone pigments such as those available under the trade names of Vat orange I and Vat orange III, substituted 2,4-diamino-triazines disclosed in U.S. Pat. No. 3,442,781, polynuclear aromatic quinones available from Allied Chemical Corporation under the trade names Indofast Double Scarlet, Indofast Violet Lake B, Indofast Brilliant Scarlet and Indofast Orange, and the like. Particularly preferred compounds include selenium, especially trigonal selenium, and dibromoanthanthrone.

The integrated photosensitivities of selenium and dibromoanthanthrone are more sensitive in the shorter wavelength region than that of benzimidazole perylene. Trigonal selenium has an actinic sensitivity of 450–550 nm and dibromoanthanthrone has an actinic sensitivity of 450–600 nm. Blending the benzimidazole perylene with either or both of these two pigments can increase the photoreceptor photoresponse in the short wavelength region and increase the total integrated photoresponse to the desired level of 450–750 nm.

Typically, the primary substituted perylene pigment employed in the practice of the present invention will be present in a range of from about 90 to about 10 weight percent of the total photogenerating particles in the photoconductive layer, with the secondary pigment(s) being present in a range of from about 10 to about 90 weight percent. More preferably, where the substituted perylene pigment is benzimidazole perylene, it will be present in the range of from about 90 to about 70 weight percent, with the secondary pigment(s) being present in a range of from about 10 to about 30 weight percent, based on the weight of the total photogenerating particles in the photoconductive layer.

Where more than one secondary pigment is employed in the practice of the invention, the ratio of one to the other for a given application can be readily optimized without undue experimentation by a person of ordinary skill in the art based on the present disclosure. For example, in the case where a combination of trigonal selenium and dibromoanthanthrone are used in combination as the secondary pigments, it has been found to be particularly useful to employ them between an amount of about 1:2 and 2:1 trigonal selenium:dibromoanthanthrone depending on the photosensitivity required in the wavelength range used in the target machine. The entire purpose of using more than one secondary pigment is to fine tune the actinic and spectral sensitivity balance. One of ordinary skill in the art knows how to establish those ratios from knowledge of the individual pigment sensitivity, assuming an additive effect.

Multi-photogenerating layer compositions can be utilized where a photoconductive layer enhances or reduces the properties of the photogeneration layer. Examples of this type of configuration are described, for example, in U.S. Pat. No. 4,415,639, the entire disclosure of which is incorporated herein by reference. Other suitable photogeneration materials known in the art may also be utilized, if desired. Charge generation layers comprising a photoconductive material such as benzimidazole perylene, amorphous selenium, trigonal selenium, selenium alloys, such as selenium-tellurium, selenium-tellurium-arsenic, selenium arsenide and the like, and mixtures thereof are especially preferred because of their actinic sensitivity. The preferred photoconductive materials for use in the charge generation layers are benzimidazole perylene, trigonal selenium, and dibromoanthanthrone.

Generally, the combination of photogenerating pigment, pigment binder polymer, and solvent should form uniform dispersions of the photogenerating pigments in the charge generation coating composition. The solvent for the charge generation film forming binder should dissolve the binder utilized in the charge generation layer and be capable of dispersing the photogenerating pigment particles used in the charge generation layer. If a dopant is included in the charge generation coating composition, it should likewise dissolve in the solvent.

The concentration of photogenerating particles in the charge generation coating composition is generally within the range of from about 5 to about 90 volume percent of the coating composition, preferably from about 7.5 to about 70 volume percent, and more preferably from about 10 to about 60 volume percent. The concentration of film forming binder in the charge generation coating composition is generally from about 95 to about 10 volume percent of the coating composition, preferably from about 92.5 to about 30 volume percent, and more preferably from about 90 to about 40 volume percent. The concentration of solvent in the charge generation coating composition is generally from about 2 to about 50 volume percent of the coating composition, preferably from about 3 to about 20 volume percent, and more preferably from about 3 to about 10 volume percent.

The charge generating layer may be formed by coating on a conductive substrate a coating composition prepared by dispersing the pigments of the present invention in a solution of the binder resin in an organic solvent. A compounding ratio of the pigments to the binder resin generally ranges from about 40/1 to about 1/10 and, preferably, from about 10/1 to about 1/4 by weight. If the ratio of the pigments is too high, the stability of the coating composition tends to be reduced. If it is too low, the sensitivity of the charge generating layer tends to be reduced.

The solvents to be used in the coating compositions are preferably selected from those incapable of dissolving the lower layer, i.e., the layer on which the charge generating layer is applied. Examples of the organic solvents include, but are not limited to, alcohols, e.g., methanol, ethanol, and isopropanol; ketones, e.g., acetone, methylethylketone, and cyclohexanone; amides e.g., N,N-dimethylformamide and N,N-dimethylacetamide; dimethylsulfoxides; ethers, e.g., tetrahydrofuran, dioxane, and ethylene glycol monomethylether; esters, e.g., methyl acetate and ethyl acetate; halogenated aliphatic hydrocarbons, e.g., chloroform, methylene chloride, dichloroethylene, carbon tetrachloride, 1,1,1-trichloroethane, 1,1,2-trichloroethane, and trichloroethylene; and aromatic hydrocarbons, e.g., benzene, toluene, xylene, ligroin, monochlorobenzene, and dichlorobenzene; mixtures thereof and the like. Other suitable solvents may be used. Mixtures of solvents may be utilized to control evaporation range. For example, satisfactory results may be achieved with a tetrahydrofuran to toluene ratio of between about 90:10 and about 10:90 by weight.

The coating composition for the charge generating layer can be coated by any suitable known coating technique, such as by hand, dip coating, spray coating, spin coating, bead coating, wire bar coating, wire wound rod coating, blade coating, roller coating, draw bar coating, gravure coating, silk screening, air knife coating, vacuum deposition, chemical treatment, curtain coating and the like. In embodiments, dip coating is preferred.

The charge generation coating composition is then preferably dried to remove the solvent. Drying of the deposited coating can be effected by any suitable conventional technique, such as oven drying, infra-red radiation drying, air drying, and the like, to remove substantially all of the solvent utilized in applying the coating. Drying after coating is preferably carried out first by drying at room temperature to the touch and then heat-drying. Heat-drying may be performed at a temperature of from 500° to 200° C. for a period of from about 5 minutes to about 2 hours in still air or in an airflow.

The charge generating layer of the present invention is generally of a thickness within the range of from about 0.05 micrometer to about 5.0 micrometers, preferably from about 0.3 micrometer to about 1.5 micrometers. Thicknesses outside these ranges can be selected, however, providing the objectives of the present invention are achieved. Higher binder content compositions generally require thicker layers for effective photogeneration. The invention is not affected by binder concentration, except that the amount of dopant, if used, will vary because the generator particle concentration is also changed.

The charge generation layer of some embodiments in accordance with the present invention may further comprise one or more dopants comprising organic molecules containing basic, i.e. electron donor or proton acceptor, groups. If a dopant is included in the charge generation coating composition, the concentration of dopant is generally in the range of from about 0 to about 1000 ppm by weight based on the weight of solvent, preferably from about 0 to about 50 ppm by weight, based on the weight of solvent; more preferably, from about 0 to about 25 ppm by weight, based on the weight of the solvent.

The Charge Transport Layer

The photoreceptors can further include a charge transport layer 7 positioned over the conductive layer and over any blocking layer. In some embodiments, the charge generation layer is positioned between the conductive layer and the charge transport layer, where one is present. In other embodiments, where a charge transport layer is present, it can be positioned between the conductive layer and the charge generation layer.

The charge transport layer 7 can comprise any suitable transparent organic polymer or non-polymeric material capable of supporting the injection of photogenerated holes or electrons from the charge generating layer 6, and allowing the transport of these holes or electrons to selectively discharge the surface charge. The charge transport layer not only serves to transport holes or electrons, but, while positioned over the charge generating layer, also protects the charge generating layer from abrasion or chemical attack and therefore extends the operating life of the imaging member.

If a charge transport layer is present, it is preferably applied by applying a charge transport coating composition comprising a charge transport film-forming binder, solvent for the charge transport film-forming binder and charge transport molecules. A dopant may also optionally be included.

If a charge transport layer is employed, its thickness is typically in the range of from about 10 micrometers to about 50 micrometers, or preferably from about 20 micrometers to about 35 micrometers. An optimum thicknesses range is from about 23 micrometers to about 31 micrometers.

The charge transport layer is substantially transparent to radiation in the region in which the imaging member is to be used. The charge transport layer is normally transparent when exposure is effected therethrough to ensure that most of the incident radiation is utilized by the underlying charge generating layer. When used with a transparent substrate, imagewise exposure or erase may be accomplished through the substrate with all light passing through the substrate. In this case, the charge transport material need not transmit light in the wavelength region of use.

The charge transport layer can comprise activating compounds dispersed in normally electrically inactive polymeric materials for making these materials electrically active. These compounds can be added to polymeric materials that are otherwise incapable of supporting the injection of photogenerated charge and incapable of allowing the transport of this charge. An especially preferred transport layer employed in multi-layer photoconductors comprises from about 25% to about 75% by weight of the charge transport layer of at least one charge transporting aromatic amine compound, and about 75% to about 25% by weight of the charge transport layer of a polymeric film-forming resin in which the aromatic amine is soluble.

The charge transport layer is preferably formed from a mixture comprising one or more tertiary amines, wherein two of the moieties attached to the amine nitrogen atom are independently selected from the group consisting of substituted or unsubstituted phenyl groups, naphthyl groups, and polyphenyl groups, and the third moiety on the amine nitrogen atom is selected from the group consisting of substituted or unsubstituted aryl groups, alkyl groups having from 1–18 carbon atoms, and cycloaliphatic groups having from 3–18 carbon atoms. The moieties should preferably be free from electron-withdrawing groups, such as $NO_2$ groups, CN groups, and the like.

Any suitable inactive resin binder soluble in methylene chloride or another suitable solvent can be employed. Typical inactive resin binders soluble in methylene chloride include polycarbonate resin, polyvinyl carbazole, polyester, polyacrylate, polyether, polysulfone, and the like. Weight average molecular weights of the resin binder can vary from about 20,000 to about 1,500,000. Other solvents that can dissolve these binders include tetrahyd rofuran, toluene, trichloroethylene, 1,1,2-trichloroethane, 1,1,1-trichloroethane, and the like.

The preferred electrically inactive resin materials are polycarbonate resins having a weight average molecular weight of from about 20,000 to about 120,000; more preferably, from about 50,000 to about 100,000. Commercially available examples of such resins include Lexan 145 and Lexan 141 from General Electric Company; Makrolon from Farbenfabriken Bayer A. G.; Merlon from Mobay Chemical Company; polyethercarbonates; and 4,4'-cyclohexylidene diphenyl polycarbonate. Methylene chloride solvent is a preferred component of the charge transport layer coating mixture for dissolving of all the components and for its low boiling point.

The Overcoating Layer

Embodiments in accordance with the present invention can, optionally, further comprise an overcoating layer or layers 8, which, if employed, are positioned over the charge generation layer or over the charge transport layer, if one is present. This layer comprises organic polymers or inorganic polymers that are electrically insulating or slightly semiconductive.

Such a protective overcoating layer preferably comprises a film forming binder doped with a charge transport compound.

Any suitable film-forming inactive resin binder can be employed in the overcoating layer of the present invention. For example, the film forming binder can be any of a number of resins, such as polycarbonates, polycarbazoles, polyarylates, polystyrene, polysulfone, polyphenylene sulfide, polyetherimide, and polyacrylate. The resin binder used in the overcoating layer can be the same or different from the resin binder used in any charge transport layer that may be present. The binder resin should preferably have a Young's modulus greater than about $2\times10^5$ psi, a break elongation no less than 10%, and a glass transition temperature greater than about 150° C. The binder may further be a blend of binders. The preferred polymeric film forming binders include Makrolon, a polycarbonate resin having a weight average molecular weight of about 50,000 to about 100,000 available from Farbenfabriken Bayer A. G., 4,4'cyclohexylidene diphenyl polycarbonate, available from Mitsubishi Chemicals, high molecular weight Lexan 135, available from the General Electric Company, Ardel polyarylate D-100, available from Union Carbide, and polymer blends of Makrolon and the copolyester Vitel PE-100 or Vitel PE-200, available from Goodyear Tire and Rubber Co.

In embodiments, a range of about 1% by weight to about 10% by weight of the overcoating layer of Vitel copolymer is preferred in blending compositions, and, more preferably, about 3% by weight to about 7% by weight. Other polymers that can be used as resins in the overcoat layer include Durel polyarylate from Celanese, polycarbonate copolymers Lexan 3250, Lexan PPC 4501, and Lexan PPC 4701 from the General Electric Company, and Calibre from Dow.

The overcoating layer can be prepared by any suitable conventional technique and applied by any of a number of application methods. Typical application methods include, for example, hand coating, spray coating, web coating, dip coating and the like. Drying of the deposited coating can be effected by any suitable conventional techniques, such as oven drying, infrared radiation drying, air drying, and the like.

Overcoatings of from about 3 micrometers to about 7 micrometers are effective in preventing charge transport molecule leaching, crystallization, and charge transport layer cracking. Preferably, a layer having a thickness of from about 3 micrometers to about 5 micrometers is employed.

The Ground Strip

Ground strip 9 can comprise a film-forming binder and electrically conductive particles. Cellulose may be used to disperse the conductive particles. Any suitable electrically conductive particles can be used in the electrically conductive ground strip layer 9. The ground strip 9 can, for example, comprise materials that include those enumerated in U.S. Pat. No. 4,664,995. Typical electrically conductive particles include, but are not limited to, carbon black, graphite, copper, silver, gold, nickel, tantalum, chromium, zirconium, vanadium, niobium, indium tin oxide, and the like.

The electrically conductive particles can have any suitable shape. Typical shapes include irregular, granular, spherical, elliptical, cubic, flake, filament, and the like. Preferably, the electrically conductive particles should have a particle size less than the thickness of the electrically conductive ground strip layer to avoid an electrically conductive ground strip layer having an excessively irregular outer surface. An average particle size of less than about 10 micrometers generally avoids excessive protrusion of the electrically conductive particles at the outer surface of the dried ground strip layer and ensures relatively uniform dispersion of the particles through the matrix of the dried ground strip layer. Concentration of the conductive particles to be used in the ground strip depends on factors such as the conductivity of the specific conductive materials utilized.

In embodiments, the ground strip layer may have a thickness of from about 7 micrometers to about 42 micrometers and, preferably, from about 14 micrometers to about 27 micrometers.

The invention will further be illustrated in the following non-limiting examples, it being understood that these examples are intended to be illustrative only and that the invention is not intended to be limited to the materials, conditions, process parameters, and the like recited herein.

EXAMPLES

Comparative Example

Benzimidazole perylene pigment is dispersed as follows: a solution of n-butyl acetate, 900 grams, and polyvinyl butyryl, 32 grams, is prepared. The benzimidazole perylene pigment, 68 grams, is added and the mixture is stirred for one hour using a high shear mixer. The mixture is then circulated through a dispersing apparatus containing 0.4 mm ZrO media to reduce the particle size to about 0.1–0.2 $\mu$m. An additional 900 grams of n-butyl acetate is added to the dispersion to prepare a charge generation layer coating composition.

The dispersion composition prepared above is added to a small dip tank. A drum that has been precoated with a 1.5 $\mu$m polyamide undercoat layer is dip coated to apply the charge generation layer. The drum is dried and overcoated with a charge transport layer to a thickness between 5–20 $\mu$m. A latent image is produced on the layered photoreceptor thus prepared by exposure with a tungsten lamp. This results in an image that has acceptable sensitivity in the visible range and high sensitivity in the near infra-red range where the exposure light has an appreciable intensity. There is, however, a very low level of background (instead of background free) present in the prints.

Example 1

The process of the Comparative Example is repeated except that 13.6 grams of trigonal selenium is substituted for a portion (13.6 grams) of the benzimidazole perylene employed therein. The charge generation layer coating composition of this Example thus comprises a mixture of charge generating materials, i.e., benzimidazole perylene and trigonal selenium. A latent image is then produced as in the Comparative Example. No background is found with this combination of charge generating materials.

Example 2

Example 1 is repeated except that 13.6 grams of dibromoanthanthrone is substituted for the 13.6 grams of trigonal selenium employed therein. Again, no background is found.

What is claimed is:

1. An electrophotographic imaging member comprising:

(a) a support and (b) at least one photoconductive layer comprising photoconductive particles, wherein all of the photoconductive particles in the photoconductive layer are n-type photosensitive pigments, wherein:

(i) from about 90% by weight to about 10% by weight of the photoconductive particles are a substituted perylene pigment, and (ii) from about 10% by weight to about 90% by weight of the photoconductive particles are at least one other n-type photosensitive pigment that is sensitive to shorter wavelength light than is the perylene pigment.

2. The electrophotographic imaging member of claim 1 wherein the perylene pigment is benzimidazole perylene.

3. The electrophotographic imaging member of claim 1 wherein said at least one other n-type photosensitive pigment is selected from the group consisting of amides of perylene perinone, chalcogens of selenium II-VI or tellurium II-V compounds, amorphous selenium, trigonal selenium, selenium alloys, dibromoanthanthrone, squarylium, quinacridones, substituted 2,4-diaminotriazines, and polynuclear aromatic quinones.

4. The electrophotographic imaging member of claim 3 wherein said at least one other n-type photosensitive pigment is selected from the group consisting of trigonal selenium and dibromoanthanthrone.

5. The electrophotographic imaging member of claim 1 wherein said photosensitive substituted perylene pigment is present in an amount of from about 90% by weight to about 70% by weight of the photoconductive particles and said at least one other n-type photosensitive pigment is present in an amount of from about 10% by weight to about 30% by weight of the photoconductive particles.

6. The electrophotographic imaging member of claim 1 wherein the photosensitive substituted perylene pigment is present in an amount of from about 82.5% by weight to about 78.5% by weight of the photoconductive particles and said at least one other n-type photosensitive pigment is present in an amount of from about 17.5% by weight to about 21.5% by weight of the photoconductive particles.

7. The electrophotographic imaging member of claim 1, wherein said photosensitive substituted perylene pigment has an actinic sensitivity in the range of from about 400 nm to 800 nm.

8. The electrophotographic imaging member of claim 1, wherein said at least one other n-type photosensitive pigment has an actinic sensitivity of from about 400 nm to 800 nm, but less than the actinic sensitivity of said photosensitive substituted perylene pigment.

9. An electrophotographic imaging member comprising:

(a) a support, and (b) at least one photoconductive layer comprising photoconductive particles, wherein all of the photoconductive particles in the photoconductive layer are n-type photosensitive pigments, wherein:

(i) from about 90% by weight to about 70% by weight of the photoconductive particles are benzimidazole perylene, and (ii) from about 10% by weight to about 30% by weight of the photoconductive particles are at least one other n-type photosensitive pigment selected from the group consisting of trigonal selenium and dibromoanthanthrone.

10. The electrophotographic imaging member of claim 9, wherein said benzimidazole perylene is present in an amount of from about 82.5% by weight to about 78.5% by weight of said photoconductive particles, and said at least one other n-type photosensitive pigment selected from the group consisting of trigonal selenium and dibromoanthanthrone is present in an amount of from about 17.5% by weight to about 21.5% by weight of said photoconductive particles.

11. An electrophotographic imaging member comprising:

(a) a support;

(b) a charge generating layer consisting essentially of: a binder, a photosensitive substituted perylene pigment, at least one other n-type photosensitive pigment and a solvent; and (c) a charge transport layer.

12. The electrophotographic imaging member of claim 11, wherein said photosensitive substituted perylene pigment is present in an amount of from about 90% to 10% by weight of said pigments in said charge generating layer, and said at least one other n-type photosensitive pigment is present in an amount of from about 10% to 90% by weight of said pigments in said charge generating layer.

13. The electrophotographic imaging member of claim 11 wherein said photosensitive substituted perylene pigment is present in an amount of from about 90% to 70% by weight of said pigments in said charge generating layer, and said at least one other n-type photosensitive pigment is present in an amount of from about 10% to 30% by weight of said pigments in said charge generating layer.

14. The electrophotographic imaging member of claim 11 wherein said photosensitive substituted perylene pigment is present in an amount of from about 82.5% to 78.5% by weight of said pigments in said charge generating layer, and said at least one other n-type photosensitive pigment is present in an amount of from about 17.5% to 21.5% by weight of said pigments in said charge generating layer.

15. The electrophotographic imaging member of claim 11 wherein said photosensitive substituted perylene pigment is benzimidazole perylene.

16. The electrophotographic imaging member of claim 11 wherein said at least one other n-type photosensitive pigment is selected from the group consisting of amides of perylene perinone, chalcogens of selenium II-VI or tellurium III-V compounds, amorphous selenium, trigonal selenium, selenium alloys, dibromoanthanthrone, squarylium, quinacridones, substituted 2,4-diamino-triazines, and polynuclear aromatic quinones.

17. The electrophotographic imaging member of claim 11 wherein said at least one other n-type photosensitive pigment is selected from the group consisting of trigonal selenium and dibromoanthanthrone.

18. The electrophotographic imaging member of claim 11 wherein said photosensitive substituted perylene pigment has an actinic sensitivity in the range of from about 400 nm to 800 nm.

19. The electrophotographic imaging member of claim 11 wherein said at least one other n-type photosensitive pigment has an actinic sensitivity of from about 400 nm to 800 nm, but less than the actinic sensitivity of said photosensitive substituted perylene pigment.

* * * * *